United States Patent [19]

Kasparian et al.

[11] Patent Number: 4,937,867

[45] Date of Patent: Jun. 26, 1990

[54] VARIABLE TIME INVERSION ALGORITHM CONTROLLED SYSTEM FOR MULTI-LEVEL SPEECH SECURITY

[75] Inventors: Kasper A. Kasparian; John D. Ide, both of Raleigh, N.C.

[73] Assignee: Teletec Corporation, Raleigh, N.C.

[21] Appl. No.: 346,282

[22] Filed: May 1, 1989

Related U.S. Application Data

[63] and a continuation-in-part of Ser. No. 30,499, Mar. 27, 1987, abandoned.

[51] Int. Cl.[5] ..... H04R 1/04

[52] U.S. Cl. ..... 380/35; 380/9; 380/36; 380/48

[58] Field of Search ..... 380/9, 35, 36, 48

[56] References Cited

U.S. PATENT DOCUMENTS

| | | | |
|---|---|---|---|
| 3,970,791 | 7/1976 | Johnson | 380/35 |
| 4,221,931 | 9/1980 | Seiler | 380/36 |
| 4,268,720 | 3/1981 | Olberg et al. | 380/36 |
| 4,295,223 | 10/1981 | Shutterly | 380/19 |
| 4,318,125 | 3/1982 | Shutterly | 380/36 |
| 4,411,017 | 10/1983 | Talbor | 380/9 |
| 4,434,323 | 2/1984 | Levine et al. | 380/48 |
| 4,443,660 | 4/1984 | DeLong | 380/36 |
| 4,551,580 | 11/1985 | Cox et al. | 380/36 |
| 4,600,941 | 7/1986 | Sakamoto et al. | 380/36 |
| 4,608,456 | 8/1986 | Paik et al. | 380/9 |
| 4,636,583 | 1/1987 | Bidell | 380/48 |
| 4,683,586 | 7/1987 | Sakamoto | 380/48 |

*Primary Examiner*—Salvatore Cangialosi

*Attorney, Agent, or Firm*—Breneman & Georges

[57] ABSTRACT

A method for scrambling speech such as in a mobile land based communication system is disclosed. Essentially, variable length time samples of digitized speech are stored and time inversion scrambled. The scrambled speech is converted back to analog form and transmitted to a receiver which reciprocates the process to reproduce the desired speech signals. Scrambling and descrambling of the speech signal is synchronized to provide corresponding sample time inversions and accurate reproduction of the speech input signal. The level of security afforded by the scrambling method may be varied by varying the length of the sampling period or by mixing forward and reverse time samples under control of an algorithm.

20 Claims, 3 Drawing Sheets

VARIABLE TIME INVERSION ALGORITHM CONTROLLED SYSTEM FOR MULTI-LEVEL SPEECH SECURITY

Cross Reference to Related Applications

The present application is a continuation in part application of U.S. Application Ser. No. 030,499 filed Mar. 27, 1987 that is interrelated to the subject matter of the following related copending patent applications: (1) U.S. Application Ser. No. 031,005 entitled Bidirectional Digital Serial Interface For Communicating Digital Signals Including Digitized Audio Between Microprocessor-Based Control And Transceiver Units of Two-Way Radio Communications Equipment filed March 27, 1987; and (2) U.S. Application Ser. No. 030,743 entitled Computerized Multistandard, Field-Convertible Multiregional/Multiservice Remote Controllable, Remote Programmable Mobile Two-Way Radio System with Digital Serial Bus Link, Built-In Programmer And Audio Diagnostics filed March 27, 1987, the disclosures of which patent applications are incorporated herein by reference.

BACKGROUND OF THE INVENTION

In the evolution of communication systems, it has become increasingly desirable to provide secure communications in a plurality of applications. The present invention relates to a method for scrambling speech or speech and data in a communication system using algorithm controlled variable time inversion.

Description of the Prior Art

Secure communication may be provided in a number of ways including frequency domain scrambling, time domain scrambling, digital scrambling, and using multidimensional scrambling techniques. Speech scrambling systems and methods are known in the patented prior art as evidenced by the U.S. Pat. Nos. to Olberg, et al U.S. Pat. No. 4,268,720 and Levine, et al U.S. Pat. No. 4,434,323.

The Olberg, et al patent, for example, discloses a system for time segment scrambling speech encoding. The scrambling unit is synchronized with a reset unit and scrambles individual segments by an inversion process. A related system for unscrambling the scrambled speech is also synchronized with the scrambler. The Levine, et al patent discloses a scrambler key code synchronizer and a method utilizing digital sequences interleaved periodically with scrambled analog information.

Generally, the prior speech scrambling systems require extensive hardware and software to render them useful and practical. The cost of such systems and the corresponding additional hardware imposes a severe limitation on the versatility of such systems.

The present invention was the product of a research effort to minimize the additional hardware required for secure speech while imparting increased levels of security and versatility in the system.

SUMMARY OF THE INVENTION

Accordingly, it is a primary object of the present invention to provide a versatile speech security system for a communications system. In accordance with the method, an analog speech input signal is sampled for a given period of time. The sampled signal is then scrambled through time inversion and the scrambled signal is transmitted to a remote receiver. At the receiver, the time inverted scrambled signal is descrambled to produce an analog speech output signal corresponding with the input signal. The scrambling and descrambling steps are synchronized to provide corresponding sample time inversions and accurate reproduction of the input signal.

Accordingly, it is a primary object of the present invention to provide a versatile speech security system for a communications system. In accordance with the method, an analog speech input signal is sampled for a given period of time. The sampled signal is then scrambled through time inversion and the scrambled signal is transmitted to a remote receiver. At the receiver, the time inverted scrambled signal is descrambled to produce an analog speech output signal corresponding with the input signal. The scrambling and descrambling steps are synchronized to provide corresponding sample time inversions and accurate reproduction of the input signal.

The present invention provides a multilevel method for the encryption of data, speech or a combination thereof by converting audio signals, scrambling digitized multibit word signals corresponding to speech or data and generating parallel supervisory multibit word digital signals to identify algorithms utilized by the software and multiplexing data serializing and communicating the encrypted audio word signals together with the parallel supervisory multibit word signals over a digital serial interface and then demultiplexing and deserializing the encrypted multibit audio word signals or data signals and supervisory multibit word signals to provide an accurate reproduction of the encrypted data, speech or combination thereof.

In accordance with a further aspect of the invention, the scrambling and descrambling steps are delayed by one sample period, whereby the analog speech output signal is delayed by two sample periods relative to the input signal.

According to a more specific embodiment of the invention, the analog speech input signal is converted to a digital signal prior to scrambling and the resulting scrambled digital signal is converted back to an analog signal prior to transmission to the receiver. Similarly, the time inverted analog signal at the receiver is converted to digital form prior to descrambling, and the resulting descrambled digital signal is converted back to an analog signal corresponding to the input signal.

According to a further embodiment of the invention, the sampling period and the synchronization and delaying steps are varied to provide several levels of scrambling.

BRIEF DESCRIPTION OF THE DRAWINGS

Other objects and advantages of the invention will become apparent to those skilled in the art from the following detailed description of the invention in conjunction with the accompanying drawing, in which.

DETAILED DESCRIPTION OF THE INVENTION

The Digital Speech Security System ($DS^3$) and method of the present invention as described herein provides a unique combination of software and hardware to provide private speech transmission in the land based mobile industry. It relies on conventional hardware for serial data communications between companion transceiver subassemblies and depends on additional custom software. The system essentially stores variable length time samples of digitized receive or transmit audio signals and reverses the time sequence of such data before restoring data to analog form and communicating this data within the restricted frequency band limitations of the mobile system. The receiver reciprocates this process and reproduces the desired speech signals. Several levels of security are readily available by varying the length of the reverse time sample and mixing the reverse time and forward time samples based on a sampling algorithm of the additional custom software.

Figure 1A:
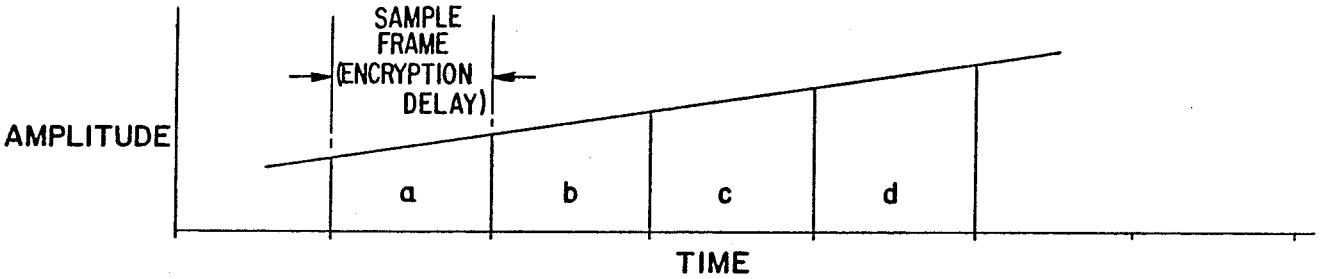
FIGS. 1*a*–1*c* are waveform representations of an original analog input signal, a time inverted and delayed version of the original signal, and the reconstructed signal resulting from descrambling and further delaying the signal, respectively.

As shown in FIG. 1*a*, the analog input signal is represented by a waveform having a variable amplitude over time. This analog signal comprises an audio speech signal which is to be transmitted over the communication system.

Figure 1B:
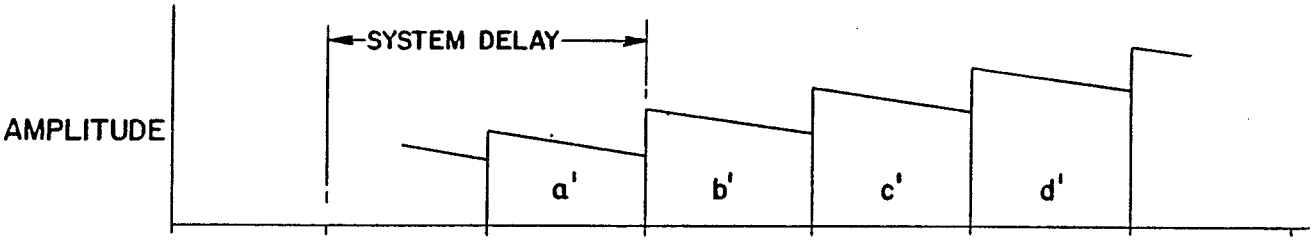
Figure 2:
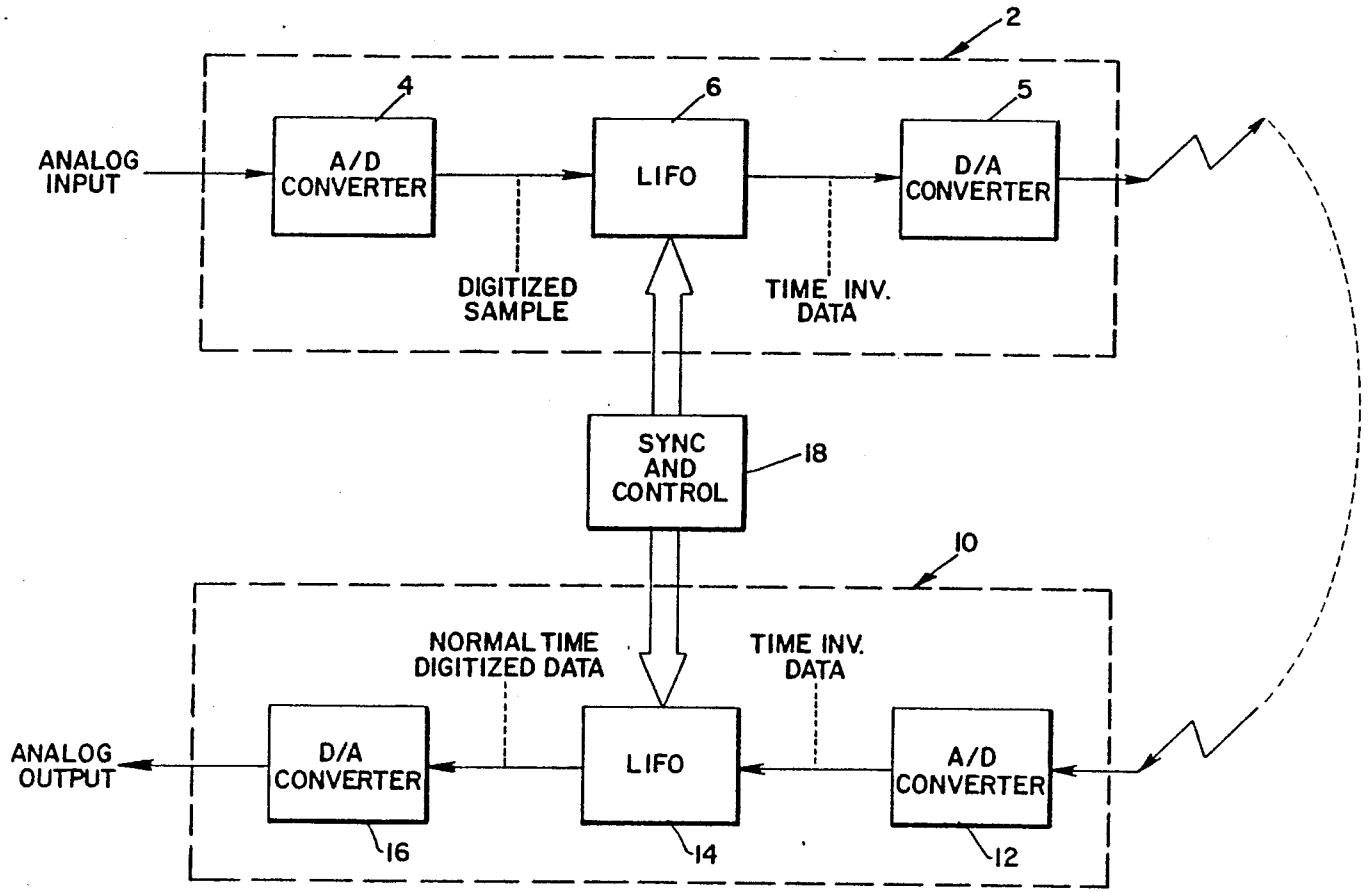
FIG. 2 is a block diagram of a time inversion scrambling system.

Referring now to FIG. 2, the analog input data signal is delivered to a transmitter 2 which includes an analog to digital (A/D) converter 4, a last-in-first-out LIFO time inversion scrambling device 6, and a digital to analog (D/A) converter 8. The analog data input is converted to digital form by the converter 4. The digital signal is stored in the LIFO device 6 in incremental segments of time, each referred to as a sample from a, b, c, d as shown in FIG. 1*a*. The segments are stored in the LIFO device 6 and delayed by a sample frame before being output in a time inverted form. FIG. 1*b* illustrates the delayed time inverted data signal, with the sample frames a', b', c', and d' corresponding with the signals from sample frames a, b, c, d of FIG. 1*a*. The time inverted digital data signal is converted back to analog form by the D/A converter 8 for transmission to a receiver 10.

Figure 1C:
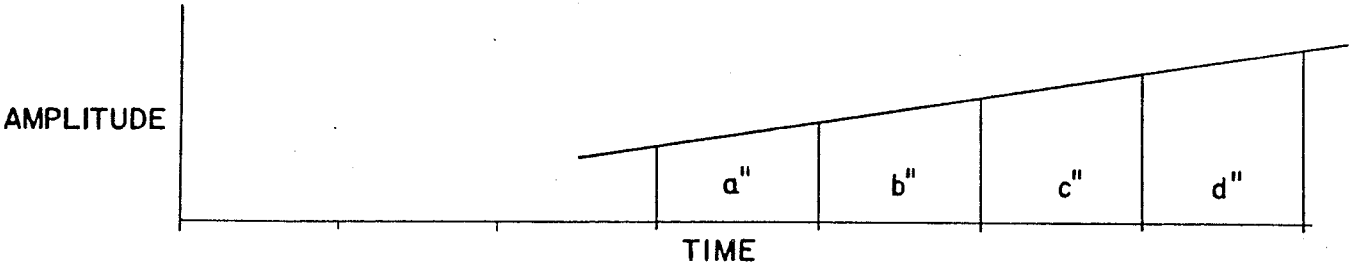

The receiver 10 essentially comprises a complementary structure to the transmitter. An A/D converter 12 converts the transmitted scrambled signal from analog to digital form and delivers the digital scrambled signal to a descrambling LIFO device 14 which stores the digital scrambled signals, delays them by an additional sample frame, and then provides an output in time inverted form to the D/A converter 16. The converter 16 converts the descrambled digital signal back to analog form and provides an analog output corresponding to the analog input data signal, delayed by two sample periods. Thus as shown in FIG. 1*c*, the output of the scrambled communication system corresponds with the input, delayed by two sample periods. More particularly, sample period a" corresponds with sample period a, b" with b, c" with c, and so on.

A synchronization and control device 18 is connected between the scrambling LIFO 6 and the descrambling LIFO 14 to insure correct scramble time inversions and accurate reconstruction of the original analog signal.

Figure 3:
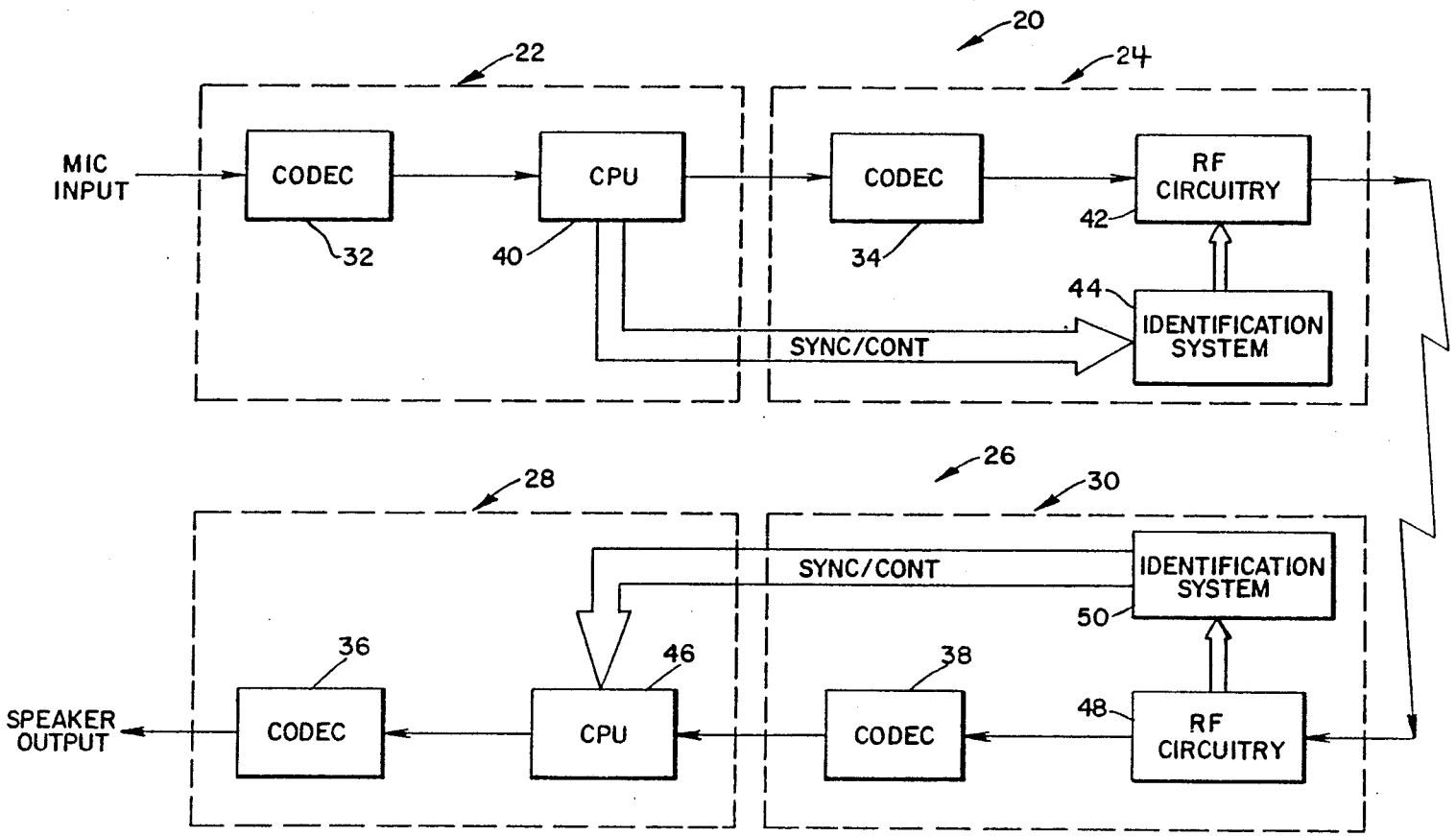
FIG. 3 is a block diagram of an alternative time inversion scrambling system utilizing the scrambling method according to the invention.

A preferred communication system for transmitting scrambled speech is shown in FIG. 3. The transmitter 20 includes control 22 and radio frequency (RF) 24 units and the receiver 26 also contains control 28 and radio frequency 30 units.

The transmitter control and RF units each contain a CODEC device 32, 34 affording communication between the units. Similarly, the receiver control and RF units also contain a CODEC device 36, 38. The CODECs contain the A/D and D/A converters shown in FIG. 2. The transmitter control unit also contains a central processing unit (CPU) 40 which contains a microprocessor and the LIFO scrambling device of FIG. 2. The CPU, under control of an algorithm, thus provides the necessary hardware for time inversion scrambling of an input speech analog signal from the microphone input to the CODEC 32. The scrambled signal is delivered to the RF unit 24 and transmitted by RF circuitry 42 to the receiver 30. The RF unit also contains an identification system 44 such as a companion sub-audible or sequential tone identification system to provide the necessary synchronization under algorithm control from the CPU.

The receiver control unit 28 also contains an algorithm controlled CPU 46 containing a microprocessor and LIFO device for descrambling the scrambled signal. The receiver RF unit 30 also contains RF circuitry 48 and an identification system 50 corresponding to those in the transmitter RF unit. The synchronization between the control units is performed in the same manner as in the embodiment of FIG. 2, under algorithm control between the CPUs. The scrambled signal is received by the receiver RF unit circuitry 48 and transmitted to the receiver CPU 46 via the CODEC 38 where the signal is descrambled in order to reconstruct at the speaker output the analog signal from the microphone input delayed by two sample periods.

The CPU 40 and the identification system 44 contain parts of a digital serial interface system. The first microcomputer in the digital serial interface system is the CPU 40 of the control unit 22. The CPU 40 contains a time division multiplexer and a pulse code modulator system (TDM/PCM). The identification system 44 contains a second microcomputer in the radio frequency unit 24 that further contains a time division demultiplexer and a pulse code demodulator system. The digital serial interface system has programmable software for multiplexing, modulating, demultiplexing and demodulating electronic signals. For a detailed description and flowcharts specifically showing the operation of the software of the digital serial interface system, further details are described in the drawings and specification in copending U.S. Application.

In the Central Processing Unit (CPU) 40, the digital signals are applied to a Time Division Multiplex/Pulse Code Modulation (TDM/PCM) System which provides a means of multiplexing and coding the signals for identification and synchronization and also translates them into a serial stream. The resultant serial data is organized in a number of channels which are then transmitted in frames to the Pulse Code Modulator in the CPU 40. The details of the TDM/PCM system are described in further detail in copending U.S. Application Ser. No. 031,003.

The channels (or words) are (digital) commands (byte), (digital) status (words of status bits), and digitized audio. As mentioned, the channel/word information, in one preferred embodiment, is transmitted in units called frames. The format of the frame is irrelevant to the heart of this invention. The essence is that both digital data information or digitized audio or a combination of units of both of them can form a frame. In a preferred embodiment each frame consists of two channel/words and is 24 bits long. The first eight bits represent the Command (Supervisory) Channel or the Status Channel, depending on which is selected. The Command (Supervisory) Channel can be transmitted at a maximum rate of one time every two frames. The next eight bits represent the Digitized Audio (Channel) word. The last eight bits contain synchronization information and housekeeping information. Cross-referenced U.S. Application Ser. No. 031,003 includes further details on the data format used by the Digital Serial Interface.

The advantage of multiplexing the scrambled signals in the CPU 40 and then demultiplexing the signals in the identification system 44 is that it provides an additional level of encryption in the system. Since the multiplexing technique is rarely associated with communication inside a device, encryption is enhanced by employing the multiplexing/demultiplexing inside the transmitter 20.

In addition to encryption/decryption, the digital supervisory/synchronization signals allow control over other radio functions. The Command (supervisory) channel, as a component of the Time Division Multiplexed digital signal, controls the operation of the CODEC devices 34 and 38. The CODEC devices 34 and 38 afford communication between the units. U.S. Application Ser. No. 031,003 includes further description of the manner in which the Command and/or Status words control the CODEC devices.

Several levels of scrambling can be incorporated in the system of FIG. 3 and modified under control of the sequential data system by transmitting synchronization information and messages identifying the algorithm being used. In this manner, the algorithm, and/or the specific level of security may be modified at the option of the user. Different algorithms may be used to vary the sample period, alter the system synchronization, or vary the time delay at the scrambler and descrambler in order to further vary the levels of security provided with the scrambling method.

While in accordance with the provisions of the Patent Statutes the preferred forms and embodiments have been illustrated and described, it will be apparent to those skilled in the art that various changes or modifications may be made without deviating from the inventive concepts set forth above. It will further be appreciated that these changes or modifications are intended to be within the spirit and scope of the invention and the following claims.

What is claimed is:

1. A method for encrypting data or speech or combinations thereof in a two-way land mobile radio, comprising:

(a) conversion of analog audio signals in a transmitting two way ratio into digitized audio multibit word signals for a sample period by utilizing a first microcomputer in a control unit side of said transmitting two way radio;

(b) scrambling said digitized audio multibit word signals through algorithms provided by the software of said first microcomputer to produce digitized scrambled multibit audio word signals and generating parallel supervisory/synchronization multibit word digital signals utilizing said first microcomputer and said software;

(c) multiplexing, serializing and communicating said digitized scrambled multibit audio word signals and said parallel supervisory/synchronization multibit word digital signals sequentially over a digital serial interface having software controlled pulse code modulation and time division multiplexing facilities to radio frequency unit of said transmitting two way radio having a second microcomputer;

(d) demultiplexing and deserializing both said digitized scrambled multibit audio word signals and said supervisory/synchronization multibit word digital signals through a reverse process in said radio frequency unit of the digital serial interface utilizing said second microcomputer in said radio frequency unit; utilizing said second microcomputer operating in conjunction with a codec to convert scrambled digitized audio signals into scrambled analog audio for transmission over the air by said transmitting two way radio; said second microcomputer operating in conjunction with a microcomputer in a radio frequency unit receiver of a similar receiving remote two way radio for deconverting said digital signals by reverse algorithm to provide the deconversion of into unscrambled analog speech; and (e) processing said supervisory/synchronization multibit word digital signals by said microcomputer in said frequency unit in said similar receiving remote two way radio affect corrections or synchronization by communicating in a reverse process to said first microcomputer in said control unit of said transmitting two way radio and synchronizing overall conversion and deconversion steps at said similar receiving remote two way ratio to provide an accurate reproduction of the encrypted audio signals.

2. The method as defined in claim 1 further comprising the step of delaying each of said conversion and deconversion steps by one sample period, whereby the analog speech is delayed by two sample periods relative to said input signal.

3. The method as defined in claim 2 further comprising the steps of converting said analog speech input signal to a digital signal prior to time inversion scrambling and converting the resulting digital time inverted signal to an analog signal prior to transmission to the receiver.

4. The method as defined in claim 3 further comprising the steps of converting the time inverted analog signal to a digital signal prior to descrambling and converting the resulting digital descrambled signal to an analog signal corresponding to said input signal.

5. The method as defined in claim 4 further comprising the step of varying said sampling period and said synchronization and delay steps to provide several levels of scrambling.

6. The method as defined in claim 5 wherein said synchronization step includes sub-audible tone identification.

7. The method as defined in claim 5 wherein said synchronization step includes sequential tone identification.

8. The method as defined in claim 5 wherein said synchronization step and said sampling period is altered to provide additional scrambling levels.

9. The method as defined in claims 1 or 2 wherein the step of scrambling further includes a step of scrambling, multiplexing and communicating digital signals corresponding to data over said digital serial interface with said digitized scrambled multibit audio word signals.

10. The method as defined in claim 1 wherein said sep of scrambling said digitized multibit word audio signals further includes the step of scrambling digital data signals.

11. The method as defined in claim 1 or 10 further comprising the step of utilizing the multiplexing facilities of said digital serial interface to provide for an additional level of encryption of said digitized scrambled multibit audio word signals.

12. A multilevel method for the encryption of data, speech or a combination thereof with other information comprising:

(a) converting audio signals into digitized multibit word signals in a first microcomputer for a sample period;

(b) scrambling said digitized multibit word signals through algorithms provided by software in said first microcomputer to provide encrypted multibit audio word digital signals;

(c) generating parallel supervisory multibit word digital signals to affect synchronization and corrective control of said encrypted multibit word signal;

(d) multiplexing, serializing and communicating said encrypted multibit audio word signals together with said parallel supervisory multibit word digital signals over a digital serial interface having software controlled pulse code modulation and time division multiplexing facilities to a second microcomputer;

(e) demultiplexing and deserializing said encrypted multibit audio word signals and said supervisory multibit word signals through a reverse process utilizing said second microcomputer in conjunction with a codec for converting said scrambled digitized multibit audio word signals into scrambled analog audio;

(f) operating said first microcomputer in conjunction with a codec and said second microcomputer and a microcomputer in a remote receiving two way radio to provide a deconversion of scrambled analog audio into unscrambled audio signals; and (g) processing said supervisory multibit word digital signals with said microcomputer in said remote receiving two way radio to provide synchronization and corrective control to provide an accurate reproduction of said audio signals.

13. The multilevel method of claim 12 further comprising the step of communicating digital multibit word signals corresponding to digital data over said digital serial interface.

14. The multilevel method of claim 13 further comprising the step of scrambling and unscrambling said digital multibit word signals corresponding to said digital data.

15. The multilevel method of claim 12 or 13 further comprising the step of utilizing different algorithms to vary the sample period, alter the system synchronization, vary a time delay or provide frequency scrambling in said scrambling and descrambling steps to further vary the levels of security.

16. A multilevel method for the encryption and transmission of data, speech or a combination thereof with other information comprising:

(a) converting audio signals in a transmitting two-way radio into digitized multibit word signals for a sample period by utilizing a first microcomputer in a control unit side of said two way radio;

(b) inputing digitized multibit word signals corresponding to digital data;

(c) scrambling said digitized audio multibit word signals or said digitized multibit word signals corresponding to digital data or a combination thereof through algorithms provided by the software of said first microcomputer to produce digitized scrambled multibit word signals and generating parallel supervisory/synchronization multibit word digital signals utilizing said first microcomputer and said software;

(d) multiplexing, serializing and communicating said digitized scrambled multibit word signals and said parallel supervisory/synchronization multibit word digital signals sequentially over a digital serial interface having software controlled pulse code modulation and time division multiplexing facilities to a radio frequency unit of said transmitting two way radio having a second microcomputer;

(e) demultiplexing and deserializing said digitized scrambled multibit word signals and said supervisory/ synchronization multibit word digital signals through a reverse process in the radio frequency unit of the digital serial interface utilizing said second microcomputer in said radio frequency unit; utilizing said second microcomputer operating in conjunction with a codec to convert scrambled multibit word signals into scrambled analog audio and data for transmission over the air by said transmitting two way radio; said second microcomputer operating in conjunction with a microcomputer in a radio frequency unit in a similar receiving remote two way radio for deconverting said digital signals by reverse algorithm to provide the deconversion of audio into unscrambled analog speech or for unscrambling said scrambled digital signals corresponding to digital data; and (f) processing said supervisory/synchronization multibit word digital signals by said second microcomputer in said radio frequency unit of said similar receiving remote two way radio to affect corrections or synchronization by communicating in a reverse process to said first microcomputer in said control unit of said transmitting two way radio and synchronizing overall said conversion and deconversion steps at said similar receiving remote two way radio to provide an accurate reproduction of the encrypted digital data or audio signals.

17. The multilevel encryption method of claim 16 wherein parallel multibit words for command and status are also applied to the digital serial interface at the control unit and radio frequency portions of said two way radio said multibit words for command and status being bidirectionally and sequentially communicating across the digital serial interface in series with digitized audio word signals and digital supervisory/synchronization signals to allow control of other radio function sin addition to encryption/decryption.

18. The multilevel encryption method of claim 16 further comprising the step of time shifting audio digital signals alone or in combination with digital data signal in said encryption step and producing decryption through reshifting to normal time sequence through reverse algorithms.

19. The multilevel encryption method of claim 16 further comprising the step of employing subaudible tones to provide identification or synchronization of the encryption level.

20. The multilevel encryption method of claim 19 wherein said step of employing subaudible tones utilizes a sequential tone.

* * * * *